United States Patent [19]

Eberwein et al.

[11] 4,338,799

[45] Jul. 13, 1982

[54] THREAD GUIDANCE SYSTEM

[75] Inventors: Eugen Eberwein, Leinfelden-Echterdingen; Heinrich Elsässer, Stuttgart; Willi Gaiser, Gäufelden; Eberhard Leins, Filderstadt; Klaus Pape, Reutlingen; Manfred Walter, Aichtal, all of Fed. Rep. of Germany

[73] Assignee: Sulzer Morat GmbH, Fed. Rep. of Germany

[21] Appl. No.: 158,513

[22] Filed: Jun. 11, 1980

[30] Foreign Application Priority Data

Jun. 22, 1979 [DE] Fed. Rep. of Germany ..... 2925217

[51] Int. Cl.[3] ..... D04B 3/06; D04B 15/52

[52] U.S. Cl. ..... 66/125 R; 66/126 R

[58] Field of Search ..... 66/125 R, 126 R, 127, 66/138

[56] References Cited

U.S. PATENT DOCUMENTS

| | | | |
|---|---|---|---|
| 528,810 | 11/1894 | Salisbury | 66/64 |
| 4,109,491 | 8/1978 | Schmid et al. | 66/125 |
| 4,173,873 | 11/1979 | Sommer et al. | 66/125 R |
| 4,173,874 | 11/1979 | Sommer et al. | 66/125 R |
| 4,196,601 | 4/1980 | Vinnemann et al. | 66/125 R |
| 4,204,414 | 5/1980 | Vinnemann et al. | 66/64 X |

*Primary Examiner*—Ronald Feldbaum

[57] ABSTRACT

A thread guide system for feeding a plurality of threads to a plurality of thread carriers moving in tandem in an endless circuit.

9 Claims, 5 Drawing Figures

THREAD GUIDANCE SYSTEM

BACKGROUND

The invention relates to a thread guidance means for feeding a plurality of threads to a textile machine working the threads, having a plurality of thread carriers running in tandem along an endless path, the filaments being fed from supply spools through movable thread guides to the thread carriers and a device being provided for the prevention of any twisting of the threads.

Certain textile machines, such as flat-bed knitting machines for example, having carriages circulating on an endless path (German OS No. 1,585,454), circular knitting machines with revolving mechanisms (German OS No. 2,540,498), warp knitting machines or undulating shed looms (German OS No. 2,450,020) have endless paths of movement on which a plurality of units run in tandem, which consist each of a thread carrier, a supply spool, a thread guide, a gripper means and, in case of necessity, also a thread clipper. Since not enough space is available for the transport of a large number of supply spools and great weights have to be transported, only a few of these units can be provided on the textile machine. Furthermore, empty supply spools can be replaced only with the textile machine shut down, and this considerably reduces production capacity.

Thread guidance systems of the kind described in the beginning have therefore become known (German OS Nos. 2,064,227 and 2,351,741) which have stationary supply spools for the threads being fed to a knitting machine, warp knitting machine or an undulating shed loom. To prevent the twisting of the threads, an endless path of movement in a kind of figure eight is provided for the thread carriers, by which it is brought about that the threads alternately twist in the one direction and in the opposite direction as the thread carriers circulate, so that after each full circuit of all thread carriers, the desired starting position can be recovered and no permanent or constantly increasing twist of the threads is possible. It is true that the parts of the threads that are between the thread carriers and the eyelet bar always touch one another and therefore rub against one another when the threads are drawn from the supply spools and fed to the textile machine. The consequence of this is differing thread tensions and damage to the threads as they are drawn from the supply spools, and this is undesirable.

Furthermore, thread guidance systems are already known (German OS No. 2,701,652) in which the twisting of the threads is prevented by the fact that, during successive circuits of the thread carriers on an endless, O-shaped path, the threads are alternately fed to the thread carriers from the one and the other side of a surface laid through a work area and a return area of the circuit. In this thread guidance system, the threads can be kept out of contact during their withdrawal from the supply spools and their delivery to the textile machine. Contact and friction between the threads, however, are possible during the return of the thread carriers, and experimenta have shown that this is sufficient to produce visible tufts and streaks, especially when threads of different color and/or character are to be used.

Lastly, contact and rubbing of the threads against one another can be reduced if in the case of thread guidance systems of the kind described in the beginning, thread guiding eyelets are provided between the sypply spools and the thread carriers, and these are disposed on two eyelet bars and during operation are constantly rocked back and forth about a common axis (German OS No. 2,064,227). This rocking movement, however, is not sufficient to completely prevent contact and friction when a large number of threads are being fed.

It is the object of the invention, therefore, to improve the thread control system described in the beginning in such a manner that contact between individual threads can be completely prevented. Another object is to prevent contact between the threads even when a very large number of threads are to be fed to the textile machine.

The invention consists in a thread guidance system for the feeding of a plurality of threads to a textile machine working the threads, having a plurality of thread carriers running in tandem in an endless circuit, the threads being carried from supply spools through movable thread guides to the thread carriers, a system for the prevention of the twisting of the threads being provided, and the thread guides being movable individually and independently of one another.

The invention sets out from the knowledge that contact and friction between the threads can be completely prevented if the thread guides, such as thread eyelets for example, instead of being moved together in sets (German OS No. 2,064,227) are moved singly and independently of one another on paths whose form on the one hand depends largely on the textile machine involved in the particular case and on the number of threads to be fed, but on the other hand always can easily be determined even when the number of threads to be fed is very large.

The thread guidance system of the invention can be used to special advantage in knitting machines pursuant to German OS No. 2,531,762 and in combination with apparatus pursuant to German OS No. 2,701,652. The term "threads", as used herein, is intended to cover all kinds of threads, as well as thread-like, ribbon or strip materials, especially glass fibers or metal wires, which can be worked by textile machines of the kind described.

Additional advantageous features of the invention will be found in the subordinate claims.

The invention will be further explained hereinbelow with reference to an example of its embodiment, in conjunction with the appended drawing, wherein.

Figure 1:
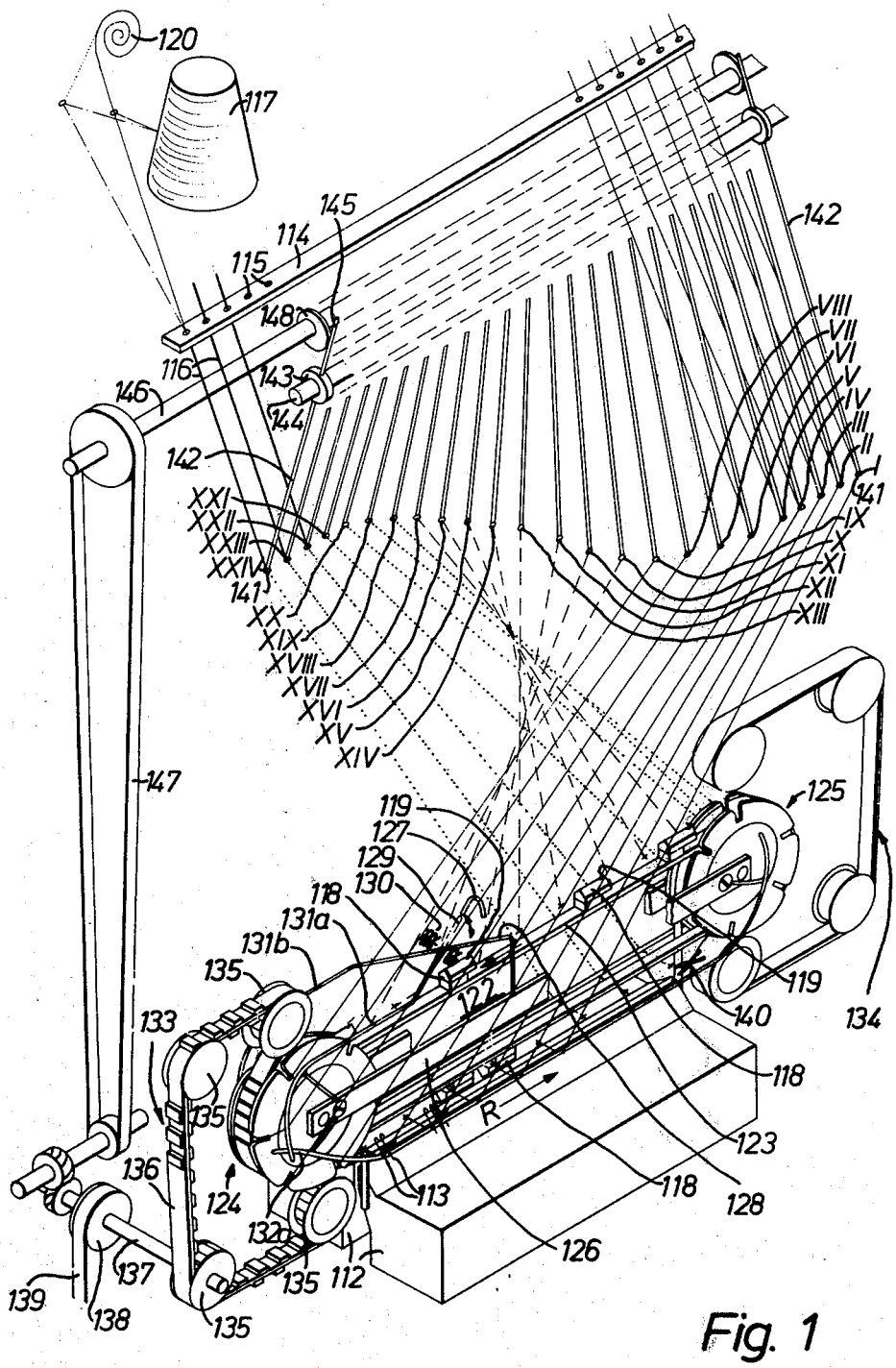
FIG. 1 is a schematic, perspective representation of the thread guidance system of the invention in conjunction with a flat-bed knitting machine.

In FIG. 1 there is shown a flat-bed knitting machine having two needle beds 112 arranged in a prism-shaped configuration, in whose grooves knitting needles 113 are guided for longitudinal displacement in a known manner. When all the knitting needles 113 are fully extended, they define a working area extending parallel to the needle beds 112, just above the crossing of the knitting needles 113, in which threads must be presented to the knitting needles so that the latter may catch them and work them into loops. Additional details of the flat-bed knitting machine, which are not necessary to the comprehension of the invention, can be found, for example, in German OS Nos. 2,531,762, 2,531,705 and 2,531,734.

The thread guidance system of the machine contains a stationary eyelet bar 114, disposed preferably parallel to the work area, through whose eyelets 115 a plurality of threads 116 are carried from stationary supply spools 117 to a plurality of thread carriers 118 having inserters in the form of thread eyelets 119, and above the eyelet bar 114, a holder 120 is indicated for each thread 116, which serves for the temporary holding of the pieces of thread released each time the thread carrier 118 returns.

For the transport of the thread carriers 118 a circulatory transporter 122 is provided, which is constituted by an endless, flexible belt 123 on which the thread carriers 118 are fastened, and two pulleys 124 and 125 whose shafts are mounted at the ends of a rigid bar 126. To bring it about that the threads 116 will be disposed alternately on the one broad side and on the other broad side of the transporter 122 as the thread carriers 118 circulate in the direction of the arrow R, and will not become twisted as a result, two guide wires 127 and 128 are provided, and a switch 129 which can be thrown back and forth between the position shown in solid lines and the position shown in broken lines in FIG. 1, by means of two electromagnets 130 which are connected by a cable, not shown, to a control apparatus. Two guide wires 131*a* and 131*b* adjoin the switch 129 and take the threads 116 distributed to the one or the other broad side of the transporter 122 and transfer them to guide wires 132*a* and 132*b*, respectively, so as to assure that the threads will not come in contact with any other parts of the thread guidance system or of the knitting machine.

To prevent the mounting of the transporter 122 from interfering with the shifting about of the threads, a support system 133, 134, is provided at each end of the transporter 122 for the floating support of the transporter 122 and acts on the outer circumference of the pulleys 124 and 125. Each support system 133, 134, consists of four pulleys 135 which are rotatably mounted outside of the transporter 122 in a frame which is not shown. It is desirable that the support system serve also as a means for driving the belt 123 carrying the thread carriers. For this purpose, a support belt 136 is laid about the support pulleys, engaging the circumference of the two end pulleys 124 and 125 so as to bear them up and drive them. The support belt 136 is provided preferably with cleats on its inner and outer sides, which engage corresponding cleats on the outer circumference of the supporting pulleys 135 and the end pulleys 124 and 125 to prevent slippage of the support belt 133. One of the support pulleys 135 is connected to a drive means having an additional pulley 138 which is fastened on the shaft 137 of this support pulley 135 and coupled by a belt 139 or the like to the drive pulley of a motor.

Figure 2:
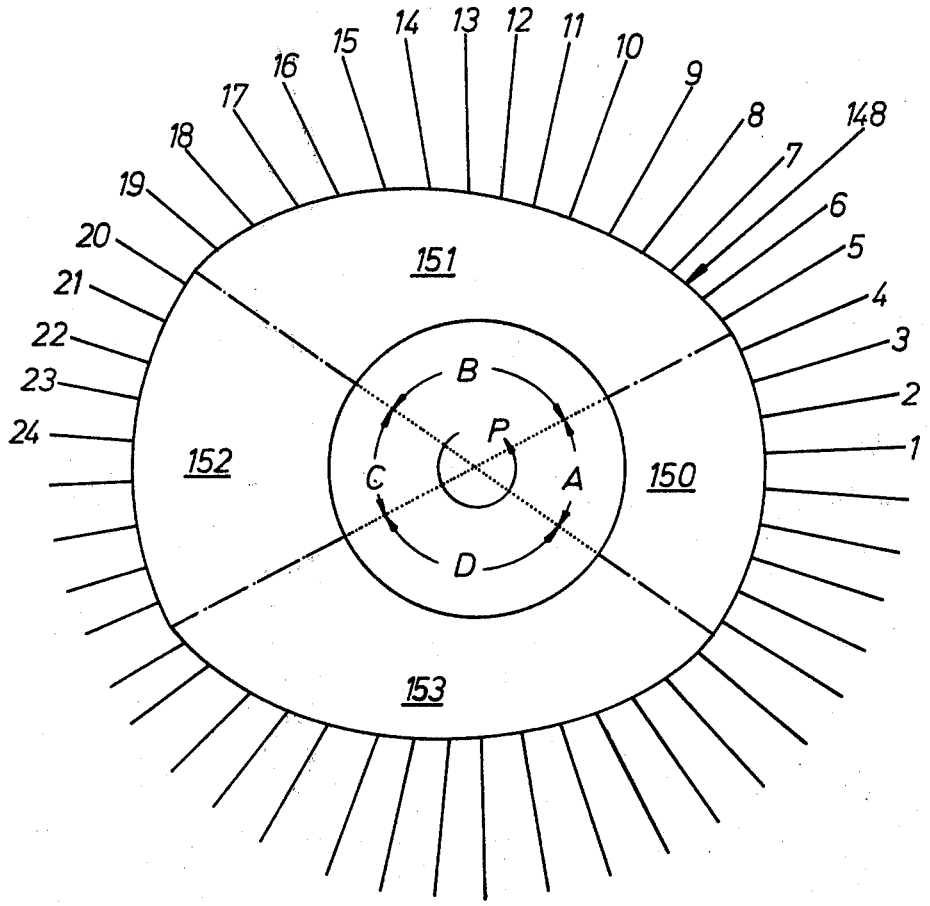
FIG. 2 is a top plan view of the cams provided in the thread guidance system shown in FIG. 1.

The operation of the thread guidance system of FIGS. 1 and 2 is as follows: Upon the repeated circulation of the thread carriers 118, the threads 116 are severed at the end of the needle bed by a cutting means 140 and are gripped by grippers which are disposed in the thread carriers (cf. German OS No. 2,351,741, for example). The gripped thread ends are returned to the start of the work area and there released by the grippers. Each thread 116, after the completion of a revolution of the belt 123, reaches the switch 129 and is deflected thereby alternately to one or the other side of the transporter 122, thereby preventing the threads 116 from being twisted. Additional details of the thread guidance system can be found in German OS No. 2,701,652.

Between the eyelet bar 114 and the transporter 122 carrying the thread carriers 118 there is provided for each thread 116 a guide means 141 in the form of a thread guide or the like, which is fastened to the end of a rocker arm 142 which is mounted on a ring 143 which can pivot about a rod 144 parallel to the eyelet bar 114 and has a free end 145 extending beyond this rod 144. Above the rod 144 and also parallel to the eyelet bar 114, a shaft 146 is rotatably mounted in a frame, which is not shown, and is coupled by a drive 147 to the shaft 137 such that it performs precisely one full revolution while the thread carriers 118 perform precisely two full circuits around the transporter 122. On the shaft 146, at a distance apart corresponding to the spacing of the free ends 145, cams 148 are disposed, against which the ends 145 of the rocker arms 142 are urged by a force, such as for example the weight of the rocker arms 142 or the force of a spring which is not shown. The cams 148 are disposed on shaft 146 with an angular offset relative to one another, i.e., adjacent cams 148 are each rotated relative to one another by an angle resulting from the quotient of 360° divided by the number of cams 48 present. If there are twenty-four cams as shown in FIG. 1, the angular offset will therefore be 15°.

The shape of the cams 148 is seen in FIG. 2. Each cam 148 can be divided into four sectors 150, 151, 152 and 153, corresponding to the angles A, B, C and D. The sector defined by angle A is a circular sector 150 corresponding to an arc of comparatively short radius. Angle B corresponds to a sector 151 having an arc with a radius that constantly increases towards sector 152. Sector 152, defined by the angle C, is a circular sector corresponding to an arc having a radius that is greater than that of the circular arc of the circular sector 150. The sector 153 defined by the angle D has an arc whose radius constantly decreases towards the sector 150. The angles A and C amount to 67.5° each, but angles B and D amount to 112.5° each. Furthermore, forty-eight symbolic lines, half of them identified in FIG. 2 by the reference numbers 1 to 24, indicate forty-eight points on the surface of the cam at distances 7.5° apart, which are engaged successively by the free ends 145 of the rocker arms 142 as the cams 148 revolve.

In FIG. 1, all of the thread guides 141 are additionally numbered I to XXIV, thread guide I being on the far right end in FIG. 1, and thread guide XXIV on the far left end. The threads 116 which they carry and the thread carriers 118 associated therewith are also to be considered as numbered in the same manner. With the thread carriers in the position indicated in FIGS. 1, 3 and 4, therefore, thread carrier I is approximately in the middle of the bottom part of the transporter 122. The thread carrier I and also the thread carriers II to V immediately following it are in a position in which they can feed threads to the knitting needles 113. The next following thread carriers VI to IX are on the end pulley 124 and cannot as yet deliver and threads. The threads carried by the thread carriers and thread guides I to IX are indicated by a solid line, because they are slipping across the front side of transporter 122 in FIG. 1, i.e., along the guide wires 131*a* and 132*a*.

The thread carriers X to XVII are, at the moment indicated in FIG. 1, on the upper part of transporter 122. The corresponding threads are indicated by a broken line in FIG. 1 because they are all in the return section of the transporter 122. Lastly, thread carriers XXIV, XXIII and XXII precede thread carrier I on the lower part of the circulation path 122, being able also to feed threads to the knitting needles 113, while the thread carriers XXI, XX, XIX and XVIII are on the pulley 125. The threads corresponding to thread carriers XVIII to XXIV are represented by dotted lines because they are slipping along the guide wires 131*b* and 132*b* on the rear side of the transporter 122.

Figure 3:
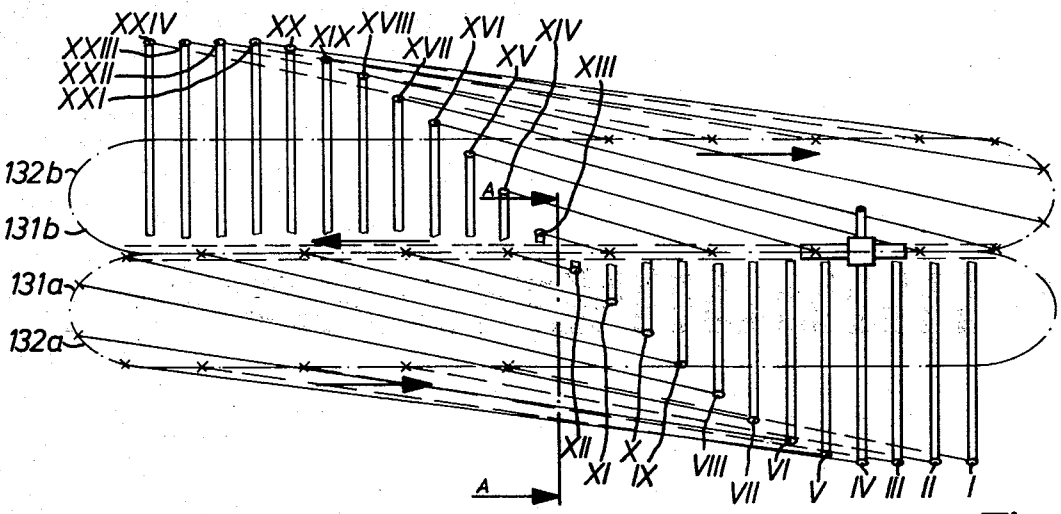
FIG. 3 is a top plan view of the thread guidance system of FIG. 1, from which unimportant parts have been omitted.

In FIG. 3 the guide wires 131 and 132 are indicated schematically by dash-dotted lines, the crosses indicating the points at which the threads engage the guide wires as indicated in FIG. 1. Since FIG. 3 is a top plan view of FIG. 1, the guide wires 131 and 132 together with the upper section of the transporter 122 are in a figure-eight-like configuration. Lastly, in FIG. 4, the rocker arms 142 and the thread guides 141 are seen in a front elevation, the crosses appearing on the left side representing schematically the front guide wire 132*a* in FIG. 1, the rear guide wire 132*b* and the upper section of the circulation path 122.

According to FIGS. 1 to 4, the thread guides I to IV associated with thread carriers I to IV are in the frontmost position, because the free ends 145 of their associated rocker arms 142 are engaging the arcs of segments 150 of the corresponding cams 148 corresponding to the symbolic lines 1 to 4 (FIG. 2). The next-following thread guides V to XIX are in intermediate positions wherein the free ends 145 of their associated rocker arms 142 ride on the arcs of segments 151 of the corresponding cams, corresponding to the symbolic lines 5 to 19. Lastly, the thread guides XX to XXIV are in the rearmost position, because the free ends 145 of their associated rocker arms 142 are riding on the arcs of the corresponding segments 152 of the cams 148 corresponding to symbolic lines 20 to 24.

The sequence of the movements is as follows. Whenever a thread carrier 118 advances by one step, i.e., in this case one twenty-fourth of the length of the transporter 122, the corresponding cam 148 likewise turns one step, i.e., it turns one forty-eighth of the cam circumference or 7.5° in the direction of the arrow P. After the first step the thread carrier I, starting out from the position shown in FIG. 1, would assume the position which thread carrier XXIV is still holding in FIG. 1. This, of course, would make no change in the position of the corresponding thread guide I because the free end 145 of the corresponding rocker arm 142 is still riding on the arc of segment 150. On the other hand, the free end 145 of the rocker arm associated with thread guide V would also have entered upon the arc of segment 150 and therefore thread guide V would already have reached the forwardmost position appropriate for the feeding of thread to the machine. Furthermore, the free end 145 of the rocker arm 142 associated with the thread guide XX would have entered upon the arc of segment 151 of the corresponding cam 148, and would thus have been swung slightly forward, while the thread guides XXI, XXII, XXIII and XXIV would remain in their rearmost position because they are still being controlled by the circular segments 152 of the corresponding cams 148.

Thread carrier I, as it can be seen in FIG. 2, can be advanced a total of five steps without any rocking movement on the part of thread guide I. This means, with reference to FIG. 1, that the thread guide I remains unmoved as long as thread guide I is still in the work area. Not until thread carrier I, after more than five steps, has reached approximately the position in which the thread carrier XIX is situated in FIG. 1, does the gradual movement of the corresponding thread guide towards the rearward position begin. After about another fourteen steps, depending on the length of the arc of segment 153, the rearward movement of the thread guide associated with thread carrier I would be virtually completed, and the thread carrier I would then assume the position occupied by thread carrier V in FIG. 1. In this new position, the corresponding thread 116 would then be on the rear side of the circulation path 122 because all threads are switched alternately forward and backward.

Figure 5:
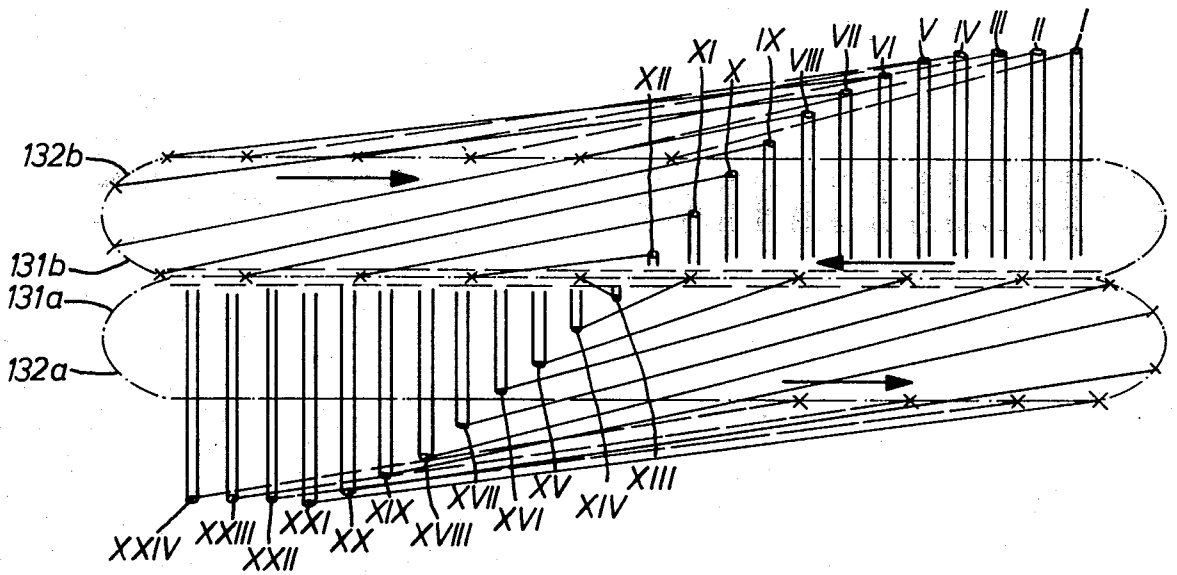
FIG. 5 is a representation corresponding to FIG. 3 in which the thread carriers are indicated in positions which they assume after one half of a course around their circuit.

It follows from the above description that those thread carriers which are in the work section on the lower part of the transporter as well as those just ahead of and just behind it, there is always associated one thread guide 141 which is shifted either all the way forward or all the way back, and that there is no change in this situation as long as the corresponding thread carrier remains in this work area, because one of the two segments 150 or 152 having an arc of a circle is always associated with this part of the transporter. On the other hand, thread guides 141 are swung from the front to the rear or from the rear to the front whenever the corresponding thread carriers are returned from the end of the needle beds 112 to the beginning thereof. In FIG. 5, in which the same parts are provided with the same reference numbers, the positions of the rocker arms 142 and the corresponding positions of the thread carriers are shown for the situation wherein thread carrier I and with it the rest of the thread carriers, setting out from the situation shown in FIG. 1, have circulated approximately once around the transporter, corresponding approximately to one half of a revolution of the corresponding cams (FIG. 2). From this it appears that the frontmost thread guides I to IV in FIG. 1 are now shifted rearwardly, and vice versa, the rearmost thread guides XX to XXIV in FIG. 1 are now all the way forward. After two full circuits of the thread guides, corresponding to one complete revolution of the cams, one cycle of operation has been completed.

Otherwise, it can be seen in FIGS. 1 to 5 that, in the system described, neither any twisting of nor any contact between the threads is possible. This is especially also due to the fact that the thread guide 141 on the extreme right in FIG. 1 is associated with the thread guide marked I in the drawing, when rotation is in the direction given, while all of the thread guides that follow are associated with the thread guides II to XXIV in the order in which they are numbered. When the direction of the thread carriers on the transporter is reversed, thread guide XXIV would have to become associated with thread carrier I, and thread guide I with thread carrier XXIV.

The invention is not restricted to the examples described above, but it is subject to many different modifications. For example, parallelism between the needle beds, the rod 144, the shaft 146 and the eyelet bar 114 does not have to be provided, although the position in which these parts can be seen in the drawing is probably the best position. Furthermore, it is not necessary to make all of the cams 148 identical or to offset them at a constant angle relative to one another. Especially when a larger number of threads is used, it may be expedient to give the cams a different shape, for example for the purpose of preventing contact between threads at the edge. Furthermore, the length of the segments 150 and 153 can be different than represented, because FIG. 1 clearly shows that the rocking of the thread guides can also start or end at an earlier or later time without any change in the desired function. Furthermore, it is not necessary to provide the cams 148 with circular segments 150 and 152. These circular segments, however, have the important advantage that they permit a complete standstill of the thread guides for the periods of time during which the corresponding thread carriers are passing through the work section, i.e., while threads are being fed to the machine. Rocking the thread guides at these times might result in undesirable variations in the thread tensions.

Figure 4:
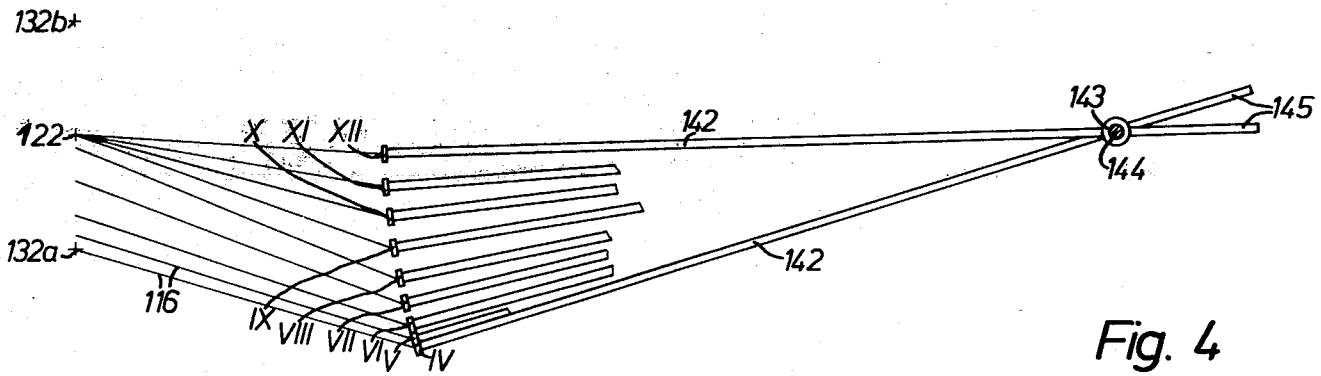
FIG. 4 is a cross section taken along line A—A of FIG. 3, wherein the position of rocker arms pivoted forward in FIG. 1 can be seen.

The amplitude or angle of the swings of the thread guides 141 which are produced by the cams 148 depends largely on the individual case and on the number of threads used. As FIGS. 1, 3 and 4 show, however, it is easy to find by testing in any case, what swings have to be performed in order to reliably prevent contact between the threads. At the same time, consideration must also be given to the fact that, depending on the individual case, contacts may be permitted between one thread and another or a few threads, i.e., it is not always necessary that all threads present be guided so as to avoid all contact. Aside from that, it would also be possible to control not all thread guides separately and independently of one another, but for example to combine the thread guides in pairs and use each cam to control the movement of two thread guides, because in this case only two threads will make brief and slight contact with one another.

Furthermore, the invention is not limited as to the manner in which the rocking or shifting of the thread guides is brought about. The control of the rocking or shifting can instead be accomplished by means of racks, camshafts and hydraulic piston-and-cylinder arrangements.

Instead of the eyelets shown in the drawing, different thread guides can be provided. The thread guides can, for example, be pairs of thread clutches or thread monitoring members, or they can consist entirely of these.

We claim:

1. Thread guidance system for the feeding of a plurality of threads to a textile machine working the threads, having a plurality of thread carriers running successively on an endless path, the threads being carried from supply spools by movable thread guides to the thread carriers, and a device being provided for preventing the twisting of the threads, characterized in that the thread guides are movable individually and independently of one another.

2. Thread guidance system of claim 1, characterized in that, for the control of the movement of each thread guide, a cam is provided.

3. Thread guidance system of claim 2, characterized in that all cams are mounted on a common shaft.

4. Thread guidance system of claim 2, characterized in that all cams are of identical configuration and are disposed with an angular offset relative to one another.

5. Thread guidance system of any of claims 2 to 4, characterized in that each cam consists of two diametrically opposite circular sectors having different radii, and two sectors disposed between them having a constantly increasing and diminishing radius, respectively.

6. Thread guidance system of claim 1, characterized in that each thread guide is fastened to a linearly displaceable element.

7. Thread guidance system of claim 1, characterized in that the thread guides consist of eyelets.

8. Thread guidance system of claim 2, characterized in that the thread guides are disposed each at the end of a rocker arm, all rocker arms (42) being pivotingly mounted at their middle part on a common rod parallel to the shaft 46, and that the free ends of the rocker arms are held in contact with the cams.

9. Thread guidance system of claim 8, characterized in that the shaft is rotatable precisely once within a period of time which corresponds to two full circuits of the thread carriers around the circulation path.

* * * * *